US005191776A

United States Patent [19]

Severance et al.

[11] Patent Number: 5,191,776

[45] Date of Patent: Mar. 9, 1993

[54] HOUSEHOLD REFRIGERATOR WITH IMPROVED CIRCUIT

[75] Inventors: Martin C. Severance; Stephen Searl, both of Louisville, Ky.

[73] Assignee: General Electric Company, N.Y.

[21] Appl. No.: 787,233

[22] Filed: Nov. 4, 1991

[51] Int. Cl.[5] ..... F25B 5/02; F25B 39/02

[52] U.S. Cl. ..... 62/513; 62/199; 62/203; 62/498; 62/504; 62/510; 62/512

[58] Field of Search ..... 62/113, 117, 199, 203, 62/440–442, 498, 335, 504, 512, 513, 510

[56] References Cited

U.S. PATENT DOCUMENTS

| | | | |
|---|---|---|---|
| 4,130,997 | 12/1978 | Hara et al. | 62/512 X |
| 4,317,335 | 3/1982 | Nakagawa et al. | 62/199 |
| 4,513,581 | 4/1985 | Mizobuchi et al. | 62/117 X |
| 4,918,942 | 4/1990 | Jaster | 62/513 X |
| 4,966,010 | 10/1990 | Jaster et al. | 62/179 |
| 5,056,328 | 10/1991 | Jaster et al. | 62/180 |

FOREIGN PATENT DOCUMENTS

| | | | |
|---|---|---|---|
| 320685 | 1/1972 | U.S.S.R. | 62/199 |
| 722652 | 1/1955 | United Kingdom | 62/441 |
| 764810 | 1/1957 | United Kingdom | 62/441 |
| 2123992 | 2/1984 | United Kingdom | 62/199 |

*Primary Examiner*—Henry A. Bennett
*Assistant Examiner*—Christopher Kilner

[57] ABSTRACT

A household refrigerator includes a refrigerant circuit having a compressor, a condenser receiving refrigerant from the compressor and a phase separator receiving refrigerant from the condenser. The liquid refrigerant containing portion of the phase separator is connected to the inlet of the freezer evaporator, the outlet of which is connected to the compressor. The vapor refrigerant containing portion of the phase separator is connected to the compressor. The fresh food evaporator is connected to the phase separator to receive liquid refrigerant from the phase separator and to return vapor refrigerant to the phase separator.

17 Claims, 2 Drawing Sheets

HOUSEHOLD REFRIGERATOR WITH IMPROVED CIRCUIT

FIELD OF THE INVENTION

The present invention relates generally to refrigeration systems and, more particularly, it relates to household refrigerators including a plurality of evaporators.

RELATED ART

This application is related to U.S. Pat. Nos. 4,910,972 and 4,918,942 issued to Heinz Jaster and assigned to General Electric, and U.S. patent application Ser. No. 07/612,290 filed on Nov. 9, 1990, for James Day, each of which is assigned to General Electric Company and each of which is incorporated herein by reference.

BACKGROUND OF THE INVENTION

A typical present day household refrigerator includes a refrigeration system which circulates refrigerant continuously through a closed circuit including a compressor, a condenser, an expansion device (normally in the form of a capillary tube), and an evaporator back to the compressor. The refrigerant is a two-phase material having a liquid phase and a vapor phase. The refrigeration system operates to cause the refrigerant to repeatedly change from a liquid to a vapor and back to a liquid to transfer energy from inside the refrigerator by removing heat from the refrigerated compartments and expelling it to the atmosphere outside the refrigerator. In a typical refrigerator the evaporator is mounted in the freezer and a fan blows air across the evaporator with the air stream being split so that most of it circulates within the freezer while a portion of it is diverted to circulate through the fresh food compartment. In this way the freezer typically is maintained between about −10° F. and +15° F. while the fresh food compartment is maintained between about +33° F. and +47° F. Such refrigerators do not operate at maximum possible efficiency as the refrigeration cycle produces the refrigeration effect at a temperature which is appropriate for the freezer, but is lower than is required to maintain the fresh food compartment at its appropriate temperature. The mechanical energy required to produce cooling at lower temperatures is greater than that required to produce cooling at higher temperatures and thus the typical simple vapor compression cycle uses more mechanical energy than one which would produce cooling at each of the two desired temperature levels.

Each of U.S. Pat. Nos. 4,910,972 and 4,918,942 discloses a refrigeration system in which a separate evaporator is used to provide the refrigeration for each of the freezer and fresh food compartments. The compressor or compression means in each of these patents takes the form of a two-stage compressor or dual compressors. Refrigerant from the freezer evaporator is fed to a low pressure stage which elevates its pressure to an intermediate level. The vapor stage refrigerant from the fresh food compartment is combined with the refrigerant exiting the low pressure compression stage and all this recirculated refrigerant is then fed to a high pressure compression stage, which raises the refrigerant pressure to the desired relatively high compressor outlet pressure.

Co-pending U.S. patent application Ser. No. 07/612,290 also discloses refrigeration circuits utilizing separate evaporators for the freezer compartment and the fresh food compartment. More particularly, it discloses the use of a compression means combining a single stage compressor with a valve which selectively connects the outlet of the freezer evaporator and vapor stage refrigerant from the fresh food compartment evaporator alternately to the single compressor. Thus, when the valve feeds refrigerant from the freezer evaporator to the compressor, the compressor raises the refrigerant pressure all the way from the low pressure of the evaporator freezer to the desired high compressor outlet pressure. On the other hand, when the valve feeds vapor refrigerant from the fresh food evaporator to the compressor, the compressor only has to raise the pressure from an intermediate pressure level to the desired compressor outlet pressure.

Each of the above-described related patents and application connect the fresh food evaporator and the freezer evaporator in series relationship in the refrigerant flow circuit, with a phase separator connected between them. The phase separator functions to separate vapor stage refrigerant and liquid stage refrigerant with the liquid refrigerant being fed to the freezer evaporator and the vapor refrigerant being fed to the compressor means. In each of these refrigerant circuits the fresh food evaporator is connected in line upstream of the phase separator. With such an arrangement, it is possible that, when the fresh food compartment needs substantial cooling, the fresh food evaporator will cause at least the vast majority of the refrigerant to vaporize. Thus, there may be insufficient liquid refrigerant in the phase separator to appropriately feed the freezer evaporator, resulting in that evaporator being "starved" and the freezer receiving insufficient cooling.

It is an object of the present invention to provide a refrigerator including an improved refrigerant system.

It is another object of the present invention to provide a household refrigerator with separate evaporators for the fresh food compartment and the freezer compartment in which the flow of refrigerant through the fresh food evaporator does not starve the freezer evaporator of refrigerant.

It is another object of the present invention to provide a household refrigerator in which the fresh food evaporator receives refrigerant from a phase separator and returns refrigerant to the phase separator.

SUMMARY OF THE INVENTION

In one aspect of the present invention a household refrigerator comprises compressor means, condenser means connected to receive refrigerant discharged from the compressor means, a phase separator connected to receive refrigerant discharged from the condenser means and to discharge vapor phase refrigerant to the compressor means. A fresh food compartment has a fresh food evaporator for refrigerating the fresh food compartment and a freezer compartment has a freezer evaporator for refrigerating the freezer compartment. The fresh food evaporator is connected to receive liquid phase refrigerant from the phase separator and to return the refrigerant to the phase separator. The freezer evaporator is connected to receive liquid phase refrigerant from the phase separator and to discharge refrigerant to the compressor means.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with accompanying drawings in which:

FIG. I is a simplified schematic side elevational representation of a household refrigerator incorporating one form of the present invention.

DETAILED DESCRIPTION OF THE PREFERRED EMBODIMENT

Figure 1:
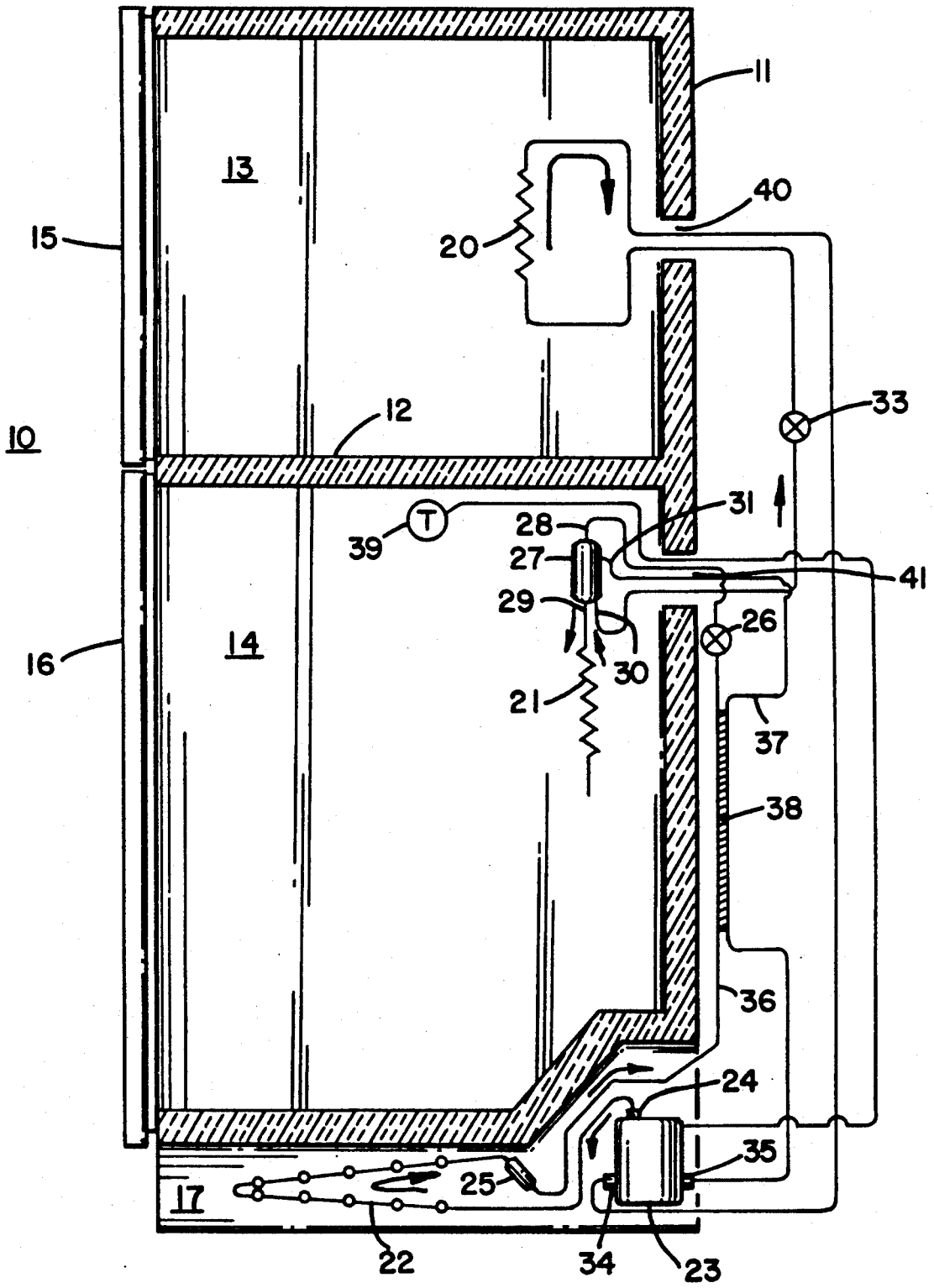

Referring now to FIG. 1, there is shown in simplified schematic form a household refrigerator 10 including an insulated outer wall 11 and an insulated dividing wall 12, separating the refrigerator into a freezer compartment 13 and a fresh food compartment 14. Doors 15 and 16 provide access to the interior of the freezer and fresh food compartments respectively. Below the fresh food compartment there is located a machinery or equipment compartment 17 which houses various operating components of the refrigerator.

The refrigeration system for the refrigerator 10 includes a first or freezer evaporator 20, a second or fresh food evaporator 21, a condenser 22 , and a compressor or compression means 23. These basic units are connected together by conduits in a fluid and vapor tight refrigerant circuit for circulation of a two phase refrigerant, as is well known in the art. More specifically, the compressor 23 is of the two stage type having a first or low pressure compression stage and a second or high pressure compression stage. The high pressure refrigerant gas or vapor exits the compressor 23 from an outlet 24 and flows to the condenser 22 where it is changed from a vapor to a liquid. From the condenser 22 the liquid refrigerant flows through a dryer 25 and a first expansion means or device 26 to a refrigerant phase separator 27, including an inlet 28 adjacent its upper end, a pair of outlets 29 and 30 adjacent its lower end and another outlet 31 at an intermediate level.

The refrigerant in the phase separator 27 separates into liquid phase refrigerant, which collects in the lower portion of the phase separator, and vapor phase refrigerant, which collects in the upper portion of the phase separator. The outlet 29 connects the lower liquid refrigerant containing portion of the phase separator to the fresh food evaporator 21. Evaporator 21 is a closed end or standpipe structure and is positioned lower than the phase separator. Liquid refrigerant flows from phase separator outlet 29 into evaporator 21 by gravity. As it extracts heat from the fresh food compartment, this refrigerant vaporizes. The vapor or gaseous refrigerant rises through evaporator 21 and returns to phase separator 27 through outlet or connection 29.

Liquid refrigerant flows from phase separator outlet 30 through a second expansion means or device 33 to freezer evaporator 20. From evaporator 20 refrigerant in a vapor state returns to a low pressure inlet 34 of the compressor 23. Vapor or gaseous state refrigerant flows from phase separator outlet 31 to intermediate pressure inlet 35 of compressor 23.

It will be understood that the expansion means or devices 26 and 33 may take any one of a number of known configurations. In a household refrigerators the expansion devices normally are in the form of capillary tubes, which allow the refrigerant to expand and begin to convert from a liquid to a vapor as it passes through the capillary tubes. Other types of refrigeration systems use expansion valves, either preset or adjustable, to permit the refrigerant to expand. Such valves also can be used in household refrigerators; however, capillary tubes are preferred for such applications as they are less expensive.

Typically, the refrigeration system of a present day household refrigerator is operated so that the freezer compartment is maintained in a temperature range between −10° F. and +15° F. while the fresh food compartment is maintained in a temperature range between about +33° F. and +47° F. Thus, the freezer evaporator 20 operates at a significantly lower temperature than the fresh food evaporator 21 and the phase separator 27. Therefore, the vapor or gaseous refrigerant flowing from the evaporator 20 to the compressor 23 is at a significantly lower pressure than the refrigerant flowing from the phase separator outlet 31 to the compressor. The refrigerant from the freezer evaporator is fed to the low pressure inlet 34 of two stage compressor 23 and is compressed by the first or low pressure compression stage to an intermediate pressure, generally corresponding to the vapor pressure of the phase separator 27. The vapor refrigerant exiting the phase separator outlet 31 is fed to the intermediate pressure inlet 35 of the compressor 23. The refrigerant from the phase separator and from the low pressure stage of the compressor then is compressed by the second or high pressure compression stage of the compressor to the relatively high exit pressure of the compressor. Thus, energy is saved because only the refrigerant necessary to cool the freezer is cycled between low level of the freezer evaporator outlet pressure and the high level of the compressor outlet pressure and the refrigerant used to cool the fresh food compartment is cycled between an intermediate pressure level necessary to provide the desired operating temperature of the fresh food compartment and the high level of the compressor outlet pressure.

The fresh food evaporator is not connected in line with the freezer evaporator. Rather it receives liquid refrigerant from the phase separator and returns vapor refrigerant to the phase separator. In particular, outlet 30, for the freezer evaporator, is the lowest connection to the phase separator; connection 29, for the fresh food evaporator, is above outlet 30 and below the normal liquid refrigerant operating level; and outlet 31 is above the operating liquid level of the phase separator 27. With this arrangement the fresh food evaporator cannot starve the freezer evaporator for refrigerant and the freezer evaporator is assured of sufficient refrigerant for appropriate operation. In addition, outlet 31 will supply only vapor phase refrigerant to compressor 23.

Conduits connect all the various components of the refrigeration system together in a complete liquid and vapor tight circuit. The conduit portion 36 connecting condenser 22 with phase separator 27 and the conduit portion 37 connecting the freezer evaporator 20 with compressor 23 are arranged in heat transfer relationship with each other, as indicated at 38. This normally is accomplished either by brazing the two lengths of conduit together or by wrapping one of the conduits tightly around the other one. This heat transfer relationship enables the relatively cold refrigerant flowing through conduit portion 37 to provide pre-cooling or intercooling of the relatively hot refrigerant flowing to phase separator 27. This intercooling further enhances the efficiency of the system and helps assure sufficient vapor phase refrigerant in phase separator 27.

A thermostat 39 is mounted in the fresh food compartment and senses the ambient temperature within that compartment. When the thermostat senses a predetermined high temperature, normally in the vicinity of the upper temperature limit of that compartment, such as +47° F. for example, it causes the compressor 23 to be connected to a source of power such as the household electric system and the compressor then will continue to run until the thermostat senses a predetermined lower temperature, normally in the vicinity of the lower limit of the operating range of the fresh food compartment, such as +33° F. for example. It will be understood that other, more involved control systems, may be used. For example, an additional thermostat that can be placed in the freezer compartment with the thermostats in the freezer and fresh food compartments cooperating to control the operation of the compressor, and thus the refrigeration system. It also will be understood that, for the sake of simplicity, various other components normally included in household refrigerators, such as for example lights and air circulating fans, have been omitted for the sake of simplicity.

It will be understood that the passage of the refrigerant conduits and wiring through the insulated wall 11 is sealed to prevent air leakage. Thus, the openings 40 and 41 are shown for ease of illustration only.

Figure 2:
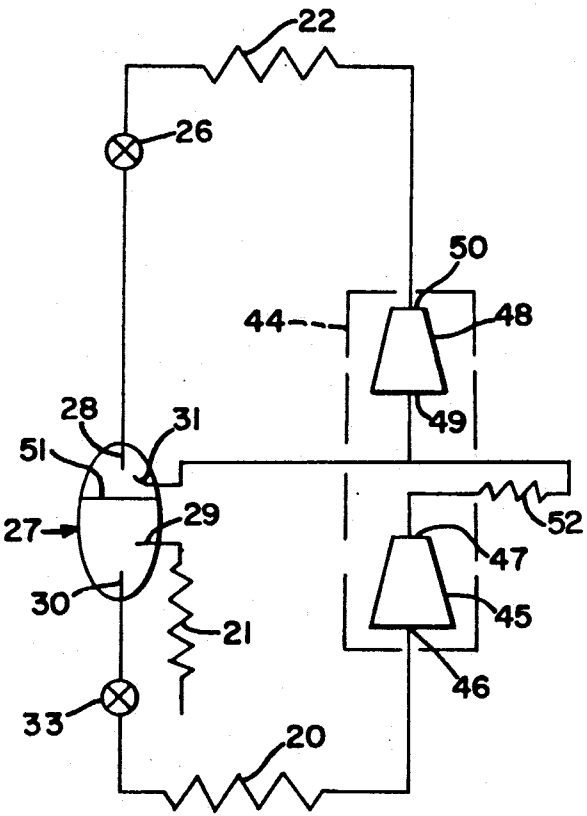
FIG. 2 is a schematic diagram of another refrigerant circuit incorporating the present invention and suitable for use in a household refrigerator.

FIG. 2, illustrates another refrigerant circuit, which is substantially similar to that included in FIG. 1 except for the compression means, and like numerals are used to identify like components. The compression means 44 includes a first, low pressure compressor 45 having an inlet 46 and an outlet 47, and a second, high pressure compressor 48 having an inlet 49 and an outlet 50. The compressors 45 and 48 may be independent of each other with each being operated by its own motor, but controlled so that they operate simultaneously. Alternatively, they may be operated by a single motor as they operate at the same time. The refrigerant exiting freezer evaporator 20 is fed to the inlet 42 of low pressure compressor 41 which compresses that refrigerant to an intermediate pressure corresponding to the pressure of the vapor phase refrigerant in phase separator 27. Both refrigerant from the low pressure compressor 41 and the vapor phase refrigerant in phase separator 27 are fed to the inlet of the high pressure compressor 48, which compresses the combined refrigerant to a high pressure. This high pressure refrigerant flows from exit 50 of the compressor 48 is fed to the condenser 22.

FIG. 2 also illustrates precooling or intercooling the refrigerant exiting from low pressure compressor 45. To that end, low pressure compressor exit 47 is connected to a heat exchanger 52 which, in turn, is connected to high pressure compressor inlet 48. The heat exchanger 52 extracts heat from and thus lowers the temperature of the refrigerant flowing out of low pressure compressor 45. Therefore, the temperature of refrigerant flowing from high pressure compressor 48 will be lower. This increases the overall refrigeration system efficiency. The heat exchanger 52 may be of the natural draft type illustrated or may have an associated fan (not shown) for increasing the heat transfer. If desired, a similar heat exchanger can be connected in the refrigerant flow path between the low and high pressure stages of two stage compressor 23 in the embodiment illustrated in FIG. 1.

FIG. 2 illustrates in more detail the positioning of the inlets and outlets of the phase separator 27. The inlet 28, feeding refrigerant from condenser 22, is positioned above the normal liquid refrigerant operating level 51. If desired, a screen, not shown, can be positioned below inlet 28 to assist in dispersing the refrigerant and enhancing refrigerant partial vaporization. The outlet 30, supplying refrigerant to freezer evaporator 20, has the lowest connection point and is well below the normal liquid refrigerant operating level 51, assuring that only liquid refrigerant is supplied to the freezer evaporator. The connection 29 for the fresh food evaporator 21 is positioned between the normal operating liquid refrigerant level 51 and the freezer evaporator outlet 30.

Connection 29 serves as both an outlet and an inlet. That is, liquid refrigerant flows from phase separator 27 through connection 29 to the fresh food evaporator 21 and vapor phase refrigerant returns to the phase separator through connection 29. Positioning connection 29 higher than outlet 30 helps assure that fresh food evaporator 21 will not vaporize so much of the refrigerant as to starve freezer evaporator 20. Also, the refrigerant vapor returning to the phase separator through connection 29 will rise within the phase separator and will not be drawn through outlet 30 to the freezer evaporator circuit.

The outlet 31 is positioned above the normal liquid refrigerant operating level 51 and preferably higher than inlet 28. This assures that only vapor phase refrigerant is fed from the phase separator to the compression means.

Figure 3:
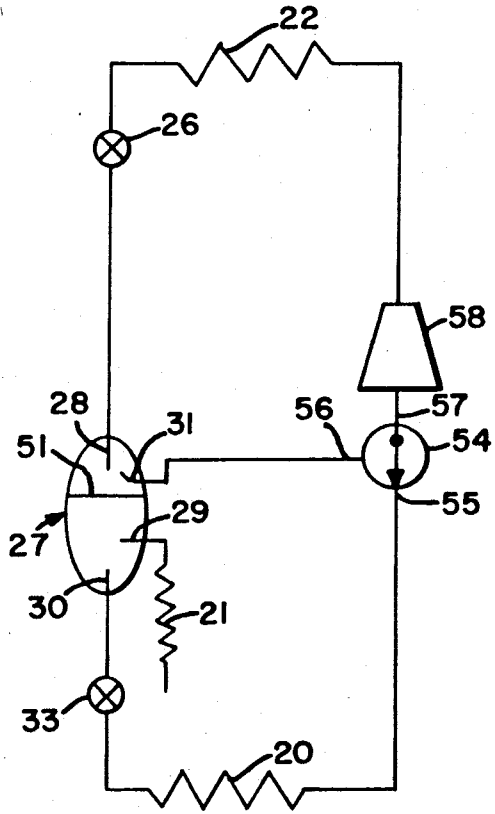
FIG. 3 is a schematic diagram of another refrigerant circuit incorporating a form of the present invention and suitable for use in a household refrigerator.

FIG. 3 illustrates another refrigerant circuit which is substantially similar to that of FIGS. 1 and 2, except that it has a compression means including a valve and a single compressor, and the same numerals have been used to identify like components. A flow control or selection valve 54, having a pair of inlets 55 and 56 and an outlet 57, is connected between the outlet of the freezer evaporator 20 and the vapor phase outlet 31 of phase separator 27, on the one hand, and the inlet of a single stage compressor 58 on the other hand. The valve 54 functions to alternately connect each of evaporator 20 and the vapor phase section of the phase separator 27 to the inlet of the compressor 58 so that, so long as the compressor 58 is operating, the valve 54 alternately conducts refrigerant from each of the evaporator 20 and phase separator 27 to compressor 58. When compressor 58 is connected to evaporator 20 it compresses refrigerant from the relatively low exit pressure of evaporator 20 to the high exit pressure of the compressor whereas, when compressor 54 is connected to phase separator 27, it compresses vapor refrigerant from an intermediate pressure to the same compressor outlet pressure. Details of construction, operation and control of valves suitable for use in this circuit are shown and described in copending U.S. patent application Ser. No. 07/612,290, incorporated herein by reference. It will be understood that compression means in the form of a two stage compressor 23 as illustrated in FIG. 1, compression means such as 44 including two separate compressors 45 and 48 as illustrated in FIG. 2; and compression means including a valve 54 and single stage compressor 58, as shown in FIGS. 3 and 4, may be utilized essentially interchangeably with various embodiments of the present invention.

Figure 4:
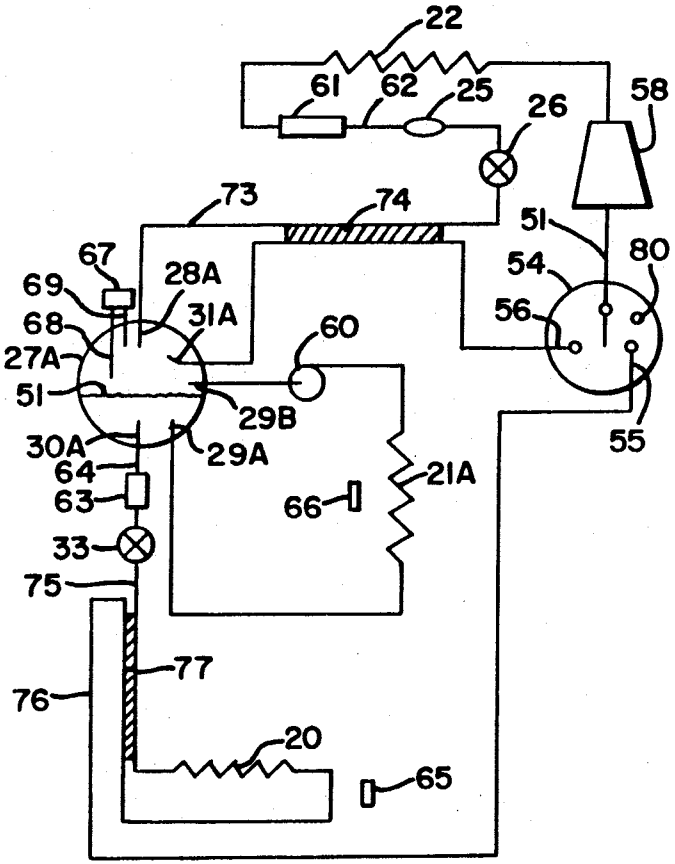
FIG. 4 is a schematic diagram of yet another refrigerant circuit incorporating one form of the present invention and suitable for use in a household refrigerator.

FIG. 4 discloses a refrigerant circuit similar to those of FIGS. 1 thru 3, except the fresh food evaporator circuit has a separate inlet and outlet and includes a pump for assuring appropriate circulation of refrigerant through the fresh food evaporator, and like numbers have been used to identify like parts.

In the embodiment of FIG. 4 the fresh food evaporator 21A is connected in series with a refrigerant pump 60 in a refrigerant circuit between an outlet 29A and an inlet 29B of the phase separator 27A. The outlet 29A is positioned below the liquid refrigerant normal operating level 51 while the inlet 29B is positioned above the normal operating level 51. When pump 60 operates it draws liquid refrigerant from the phase separator through outlet 29A and discharges vapor refrigerant back into the phase separator through inlet 29B.

With some refrigerators the refrigerant pump 60 may be omitted. When the valve 54 connects phase separator outlet 31A to compressor 58, the compressor extracts vapor refrigerant from the phase separator and reduces the pressure in the upper, vapor containing portion of the phase separator. It also will tend to draw vapor refrigerant from the fresh food evaporator circuit through inlet 29B. This action may even pump liquid through the fresh food evaporator circuit, that is at least some of the refrigerant returning to the phase separator through inlet 29B will be in the liquid phase.

FIG. 4 also illustrates other active components of a refrigeration control, including: a valve 61 positioned in the conduit 62 connecting condenser 22 and expansion device 26; a valve 63 positioned in the conduit 64 connecting phase separator 27A and expansion device 33; a thermostat or cold control 65 positioned to sense the temperature in freezer compartment 13; a thermostat or cold control 66 positioned to sense the temperature in the fresh food compartment; and a liquid level sensor 67 having a low liquid level probe 68 and a high liquid level probe positioned within phase separator 27A. The valves 61 and 63 are constructed and arranged such that, when open, they permit refrigerant to flow through conduits 62 and 64 respectively and, when closed, prevent such flow. The low level probe 68 is constructed and arranged so that sensor 67 provides an appropriate signal when the level of liquid refrigerant in the phase separator falls sufficiently that it approaches the level of outlet 29A. Similarly, high level probe 69 is constructed and arranged so that sensor 67 provides an appropriate signal when the level liquid refrigerant in the phase separator rises sufficiently to approach the level of inlet 28A.

The cold controls sense the temperature in their respective compartments and each is "ON" when calling for cooling of its compartment and "OFF" when not calling for cooling of its compartment.

A suitable control scheme for the refrigeration circuit of FIG. 4 includes the following operating conditions. Compressor 58 operates when freezer cold control 65 is ON and liquid refrigerant in phase separator 27A is low (below probe 68). Valve 61 is open when compressor 58 operates. Valve 63 is open when freezer cold control 65 is ON. Pump 60 operates when fresh food cold control 66 is ON. The selection valve 54 is in a null position 80, not connecting either of inlets 55 and 56 to outlet 57, when the compressor 58 is OFF. The valve 54 alternately connects inlets 55 and 56 to outlet 57, and thus compressor 58, when the compressor is operating. This alternate connection conveniently can be on a timed basis. If compressor 58 is operating and the level of phase separator liquid refrigerant falls below low level probe 68, then valve 54 will stop connecting inlet 55 to compressor 58 until the liquid refrigerant level again rises above probe 68. This assures that vapor refrigerant is not drawn into freezer evaporator 20.

Conveniently a separate fan, not shown, may be associated with each of condenser 22 and evaporators 20 and 21. The condenser fan would operate when the compressor is operated; the freezer evaporator fan would operate when the freezer cold control 65 is ON and the fresh food evaporator fan would operate when the fresh food cold control is ON.

The conduit 72 connecting phase separator outlet 31A to valve inlet 56 is arranged in heat transfer relationship with the conduit 73 connecting expansion device 26 with phase separator inlet 28A, as indicated at 74. The arrangement pre-cools or intercools refrigerant entering the phase separator and assists in the phase separator partial vaporization of the refrigerant. Similarly, the conduit 75 between expansion device 33 and freezer evaporator 20 is arranged in heat transfer relationship with outlet conduit 76 of evaporator 20, as indicated at 77. This provides pre-cooling or intercooling of the refrigerant supplied to evaporator 20.

The construction operation and electrical interconnection of the various control components to obtain a suitable mode of operation is clearly within the skill of those skilled in the art and their description has been omitted for the sake of simplicity.

What is claimed is:

1. A refrigerator comprising:

compressor means;

condenser means connected to receive refrigerant discharged from said compressor means;

a refrigerant phase separator connected to receive refrigerant discharged from said condenser means and including a receptacle for accumulating liquid phase refrigerant in its lower portion and vapor phase refrigerant in its upper portion;

a fresh food compartment, a fresh food evaporator for refrigerating said fresh food compartment, said fresh food evaporator being connected to said phase separator to receive liquid phase refrigerant from said phase separator and to discharge vapor phase refrigerant back to said phase separator;

a freezer compartment, a freezer evaporator for refrigerating said freezer compartment and connected to receive liquid phase refrigerant from said phase separator and to discharge vapor phase refrigerant to said compressor means; and means connecting said upper portion of said phase separator with said compressor means for conducting vapor phase refrigerant from said phase separator to said compressor means.

2. A refrigerator as set forth in claim 1, wherein said compressor means includes a low pressure stage and a high pressure stage and wherein said freezer evaporator is connected to discharge refrigerant to said low pressure stage and said conduit means is connected to conduct refrigerant from said phase separator to said high pressure stage.

3. A refrigerator as set forth in claim 1 further including refrigerant flow control means connected in refrigerant flow relationship between and operable to selectively connect said compressor means with each of said freezer evaporator and said upper portion of said phase separator.

4. A refrigerator as set forth in claim 1 wherein said fresh food evaporator is of a heat pipe construction having a single connection to said phase separator to both receive refrigerant from said evaporator and discharge refrigerant to said phase separator.

5. A refrigerator as set forth in claim 4, wherein said compressor means includes a low pressure stage and a high pressure stage and wherein said freezer evaporator is connected to discharge refrigerant to said low pressure stage and said means connecting said upper portion of said phase separator to said compressor means is effective to conduct refrigerant from said phase separator to said high pressure stage.

6. A refrigerator as set forth in claim 5 further including heat exchange means connected in refrigerant flow relationship between said low pressure stage and said high pressure stage of said compressor means.

7. A refrigerator as set forth in claim 4 further including refrigerant flow control means connected in refrigerant flow relationship between and operable to selectively connect said compressor means with each of said freezer evaporator and said means for connecting said upper portion of said phase separator to said compressor means.

8. A refrigerator as set forth in claim 1, further including; first refrigerant expansion means connected in refrigerant flow relationship between said condenser means and said phase separator, second refrigerant expansion means connected in refrigerant flow relationship between said phase separator and said freezer evaporator.

9. A refrigerator as set forth in claim 8, further comprising: a first conduit connecting said first expansion means with said phase separator, a second conduit connecting said upper portion of said phase separator with said compressor means and wherein at least a portion of said first conduit is arranged in heat transfer relationship with at least a portion of said second conduit.

10. A refrigerator as set forth in claim 8, further comprising a third conduit connecting said second refrigerant expansion means with said freezer evaporator, a fourth conduit connecting said freezer evaporator with said compressor means and wherein at least a portion of said third conduit is arranged in heat transfer relationship with at least a portion of said fourth conduit.

11. A refrigerator as set forth in claim 2 wherein said fresh food evaporator has an inlet connected to receive refrigerant from said lower portion of phase separator and to discharge refrigerant to said upper portion of said phase separator.

12. A refrigerator as set forth in claim 11, further including means effective to pump refrigerant from said phase separator thorough said fresh food evaporator and back to said phase separator.

13. A refrigerator as set forth in claim 11, wherein said compressor means includes a low pressure stage and a high pressure stage and wherein said freezer evaporator is connected to discharge refrigerant to said low pressure stage and said means connecting said upper portion of said phase separator to said compressor means is effective to conduct refrigerant from said phase separator to said high pressure stage.

14. A refrigerator as set forth in claim 11 further including refrigerant flow control means connected in refrigerant flow relationship between and operable to selectively connect said compressor means with each of said freezer evaporator and said means for connecting said upper portion of said phase separator to said compressor means.

15. A refrigerator as set forth in claim I wherein said refrigerant phase separator has a normal operating liquid refrigerant level located intermediate its upper and lower ends and further comprising: first conduit means connected to said phase separator well below the normal operating liquid refrigerant level for transfer of liquid refrigerant to said freezer evaporator; second conduit means connected to said phase separator between the normal operating liquid refrigerant level and the connection of said first conduit for transfer of refrigerant to said fresh food evaporator and; third conduit means connected to said phase separator above the normal liquid refrigerant level for transfer of refrigerant to said compressor means.

16. A refrigerator as set forth in claim 15 further comprising fourth conduit means connected to said phase separator above the normal liquid refrigerant level for return of refrigerant from said fresh food evaporator to said phase separator.

17. A refrigerator as set forth in claim 16 further comprising pump means connected in series refrigerant flow relationship with said fresh food evaporator for effecting flow of refrigerant through said fresh food evaporator.

* * * * *